US011723830B1

(12) United States Patent
Marton et al.

(10) Patent No.: US 11,723,830 B1
(45) Date of Patent: Aug. 15, 2023

(54) PERCUSSIVE MASSAGE DEVICE WITH SELF-LUBRICATING CYLINDER

(71) Applicant: Hyperice IP SubCo, LLC, Irvine, CA (US)

(72) Inventors: Robert Marton, Yorba Linda, CA (US); Anthony Katz, Laguna Niguel, CA (US)

(73) Assignee: Hyperice IP SubCo, LLC, Irvine, CA (US)

( * ) Notice: Subject to any disclaimer, the term of this patent is extended or adjusted under 35 U.S.C. 154(b) by 356 days.

(21) Appl. No.: 17/121,210

(22) Filed: Dec. 14, 2020

Related U.S. Application Data

(60) Provisional application No. 62/949,093, filed on Dec. 17, 2019.

(51) Int. Cl.
*A61H 23/00* (2006.01)
*A61H 23/02* (2006.01)

(52) U.S. Cl.
CPC ..... *A61H 23/006* (2013.01); *A61H 23/0254* (2013.01); *A61H 23/0263* (2013.01); *A61H 2201/0188* (2013.01); *A61H 2201/1215* (2013.01); *A61H 2201/1436* (2013.01); *A61H 2201/1666* (2013.01); *A61H 2201/1676* (2013.01)

(58) Field of Classification Search
CPC ..... A61H 23/006; A61H 23/0254; A61H 23/0263; A61H 2201/0188; A61H 2201/1215; A61H 2201/1436; A61H 2201/1666; A61H 2201/1676
See application file for complete search history.

(56) References Cited

U.S. PATENT DOCUMENTS 4,513,737 A * 4/1985 Mabuchi ..... A61H 23/0254 601/108
4,827,914 A * 5/1989 Kamazawa ..... A61H 23/0254 601/67
4,841,955 A * 6/1989 Evans ..... A61H 23/0218 601/108
6,616,621 B1 9/2003 Kohr
6,682,496 B1 * 1/2004 Pivaroff ..... A61H 7/005 601/107
9,889,066 B2 * 2/2018 Danby ..... A61H 23/0254
10,314,762 B1 6/2019 Marton et al.
10,357,425 B2 7/2019 Wersland et al.
(Continued)

FOREIGN PATENT DOCUMENTS

CN 101801326 A 8/2010

*Primary Examiner* — Quang D Thanh
(74) *Attorney, Agent, or Firm* — Patterson Intellectual Property Law, P.C.; Jerry Turner Sewell

(57) ABSTRACT

A percussive massage device includes a self-lubricating cylinder extending along a longitudinal axis. A motor shaft rotates about a central axis perpendicular to the longitudinal axis. A crank coupled to the shaft includes a pivot offset from the central axis. A reciprocation linkage is coupled between the pivot and a piston that moves longitudinally within the cylinder. An applicator head coupled to a second end of the piston has an end exposed outside the cylinder for application to a person receiving treatment. An annular gasket positioned between the cylinder and the applicator head removes lubricant from an outer surface of the piston to inhibit the lubricant from reaching the applicator head.

10 Claims, 8 Drawing Sheets

(56) References Cited

U.S. PATENT DOCUMENTS

| | | | |
|---|---|---|---|
| 10,492,984 | B2 | 12/2019 | Marton et al. |
| 10,561,574 | B1 | 2/2020 | Marton et al. |
| 10,702,448 | B2 | 7/2020 | Wersland et al. |
| 10,888,492 | B2 | 1/2021 | Marton et al. |
| 10,905,627 | B2 | 2/2021 | Marton et al. |
| 10,912,708 | B2 | 2/2021 | Marton et al. |
| 2009/0270915 | A1 | 10/2009 | Tsai et al. |
| 2015/0107383 | A1 | 4/2015 | Duesselberg et al. |
| 2018/0200141 | A1 | 7/2018 | Wersland et al. |
| 2019/0209424 | A1 | 7/2019 | Wersland et al. |
| 2020/0261307 | A1 | 8/2020 | Wersland et al. |
| 2020/0330321 | A1 | 10/2020 | Wersland et al. |

* cited by examiner

PERCUSSIVE MASSAGE DEVICE WITH SELF-LUBRICATING CYLINDER

RELATED APPLICATIONS

The present application claims the benefit of priority under 35 USC § 119(e) from U.S. Provisional Application No. 62/949,093 filed on Dec. 17, 2019, which is incorporated herein by reference in its entirety.

FIELD OF THE INVENTION

The present invention is in the field of therapeutic devices, and, more particularly, is in the field of devices that apply percussive massage to selected portions of a body.

BACKGROUND OF THE INVENTION

Percussive massage, which is also referred to as tapotement, is the rapid, percussive tapping, slapping and cupping of an area of the human body. Percussive massage is used to more aggressively work and strengthen deep-tissue muscles. Percussive massage increases local blood circulation and can even help tone muscle areas. Percussive massage may be applied by a skilled massage therapist using rapid hand movements; however, the manual force applied to the body varies, and the massage therapist may tire before completing a sufficient treatment regime.

Percussive massage may also be applied by electromechanical percussive massage devices (percussive applicators), which are commercially available. Such percussive applicators may include, for example, an electric motor coupled to drive a reciprocating piston within a cylinder. A variety of percussive heads may be attached to the piston to provide different percussive effects on selected areas of the body. Percussive massage devices operate at a high repetition rate (e.g., a range from 2,000 strokes per minute to 3,000 strokes per minute. To prevent vibration, the outer diameter of the piston has a tight tolerance with respect to the inner diameter of the cylinder. The tight tolerance causes heat because of the friction between the piston and cylinder. The friction can be reduced by applying oil between the two elements; however, the use of machine oil in a percussive massage environment is not desirable because a small portion of the oil may seep from the cylinder onto the rapidly reciprocating percussive head. An alternative to adding oil to a cylinder is to use a cylinder that is self-lubricating. Self-lubricating bearings that include a lubricant impregnated within the bearing are known and may be used as a cylinder. However, the lubricant within self-lubricating bearings may accumulate in the interface between the cylinder and the piston and may be ejected by the piston onto the percussive head.

SUMMARY OF THE INVENTION

A need exists for an electromechanical percussive massage device having a self-lubricating cylinder that reduces or eliminates oil from being ejected from the cylinder onto a percussive head of the massage device.

One aspect of the embodiments disclosed herein is a percussive massage device that includes a self-lubricating cylinder extending along a longitudinal axis. A motor shaft rotates about a central axis perpendicular to the longitudinal axis. A crank coupled to the shaft includes a pivot offset from the central axis. A reciprocation linkage is coupled between the pivot and a piston that moves longitudinally within the cylinder. An applicator head coupled to a second end of the piston has an end exposed outside the cylinder for application to a person receiving treatment. An annular gasket positioned between the cylinder and the applicator head removes lubricant from an outer surface of the piston to inhibit the lubricant from reaching the applicator head.

Another aspect in accordance with embodiments disclosed herein is a percussive massage device that includes an enclosure having a proximal end and a distal end. A motor is positioned within the enclosure. The motor is operable to rotate a crank having an offset pivot. A reciprocation linkage has a proximal end and a distal end. The proximal end of the reciprocation linkage is coupled to the offset pivot of the crank. An outer sleeve is mounted to the distal end of the enclosure. The outer sleeve has a proximal end and a distal end. The proximal end of the outer sleeve is attached to the distal end of the enclosure. The outer sleeve has an inner surface. A self-lubricating cylinder is positioned within the outer sleeve. The cylinder has a proximal end and a distal end. A piston is positioned through the cylinder. The piston has a proximal end and a distal end. The proximal end of the piston is coupled to the distal end of the reciprocation linkage. The distal end of the piston extends from the distal end of the cylinder. An annular gasket has a distal surface positioned against the inner surface of the outer sleeve and has a proximal surface. A pressure ring has a distal surface positioned against the proximal surface of the annular gasket and has a proximal surface positioned against the distal end of the cylinder. An applicator head has a distal end and a proximal end. The proximal end of the applicator head is removably couplable to the distal end of the piston. The proximal end of the applicator head is exposed outside the distal end of the outer sleeve.

In certain embodiments in accordance with this aspect, the annular gasket comprises a wool felt material. In certain embodiments in accordance with this aspect, the wool felt material of the annular gasket has a density in a range of 3 grams to 3.5 grams per cubic centimeter. In certain embodiments in accordance with this aspect, the wool felt material has an uncompressed thickness in a range of 1.2 millimeters to 2 millimeters.

In certain embodiments in accordance with this aspect, the annular gasket has an inner peripheral surface. The inner peripheral surface has an inner diameter. The piston has a cylindrical outer surface. The outer surface has an outer diameter. The inner diameter of the peripheral surface of the annular gasket is substantially equal to the outer diameter of the outer surface of the piston.

In certain embodiments in accordance with this aspect, the pressure ring comprises polyethylene.

In certain embodiments in accordance with this aspect, the pressure ring has an inner peripheral surface having an inner diameter. The inner diameter of the inner peripheral surface of the pressure ring is greater than the outer diameter of the outer surface of the piston.

In certain embodiments in accordance with this aspect, the inner surface of the outer sleeve comprises a plurality of inner surface segments. Each inner surface segment is spaced part from adjacent inner surface segments. The annular gasket is compressed between the pressure ring and each of the inner surface segments.

Another aspect in accordance with embodiments disclosed herein is a method of operating a percussive massage device. The method comprises rotating a shaft of an electric motor to rotate a pivot of a crank about a centerline of the shaft. The method further comprises coupling the pivot of the crank to a proximal end of an interconnection linkage and coupling a distal end of the interconnection linkage to a proximal end of a piston. The method further comprises constraining the piston to reciprocate within the central bore of a self-lubricating cylinder body. An outer surface of the piston receives lubricant from the cylinder body. The method further comprises passing the piston through an annular gasket. The annular gasket has an inner perimeter positioned in contact with the outer surface of the piston. The annular gasket absorbs lubricant from the outer surface of the piston. The method further comprises coupling a second end of the piston to an applicator head. Rotational movement of the pivot of the crank causes reciprocating longitudinal movement of the piston and the applicator head. The annular gasket inhibits the lubricant on the outer surface of the piston from reaching the applicator head.

In certain embodiments in accordance with this aspect, the method further comprises positioning the annular gasket between a pressure ring and a segmented surface having a plurality of surface segments to enable the annular gasket to expand between the surface segments.

BRIEF DESCRIPTIONS OF THE DRAWINGS

The foregoing aspects and other aspects of the disclosure are described in detail below in connection with the accompanying drawings in which.

Figure 1:
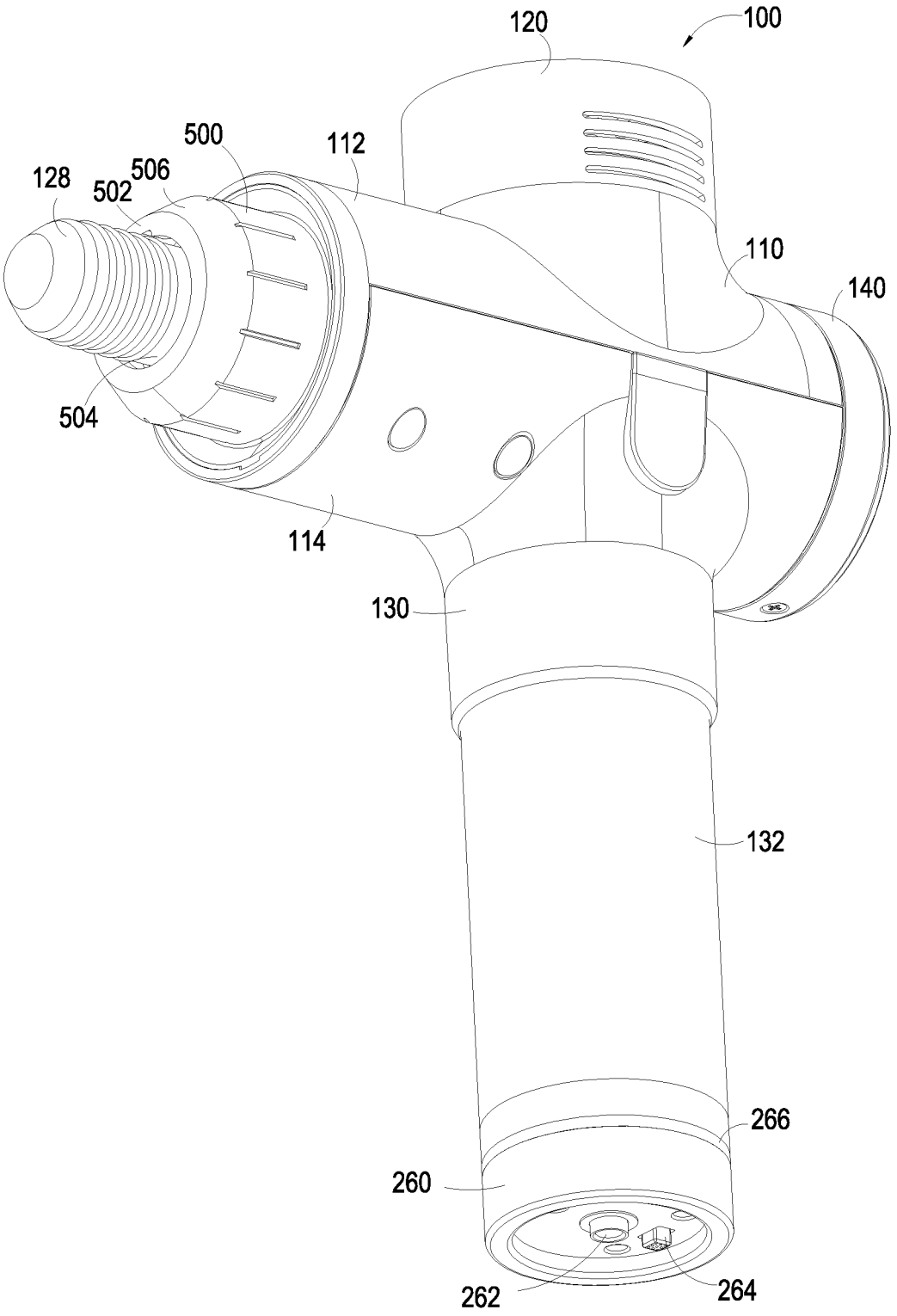
FIG. 1 illustrates a bottom perspective view of a portable electromechanical percussive massage applicator that is battery powered and has a single hand grip, the view in FIG. 1 showing the bottom, the left side and the distal end of the applicator with a removable massage head attached to the applicator.
Figure 2:
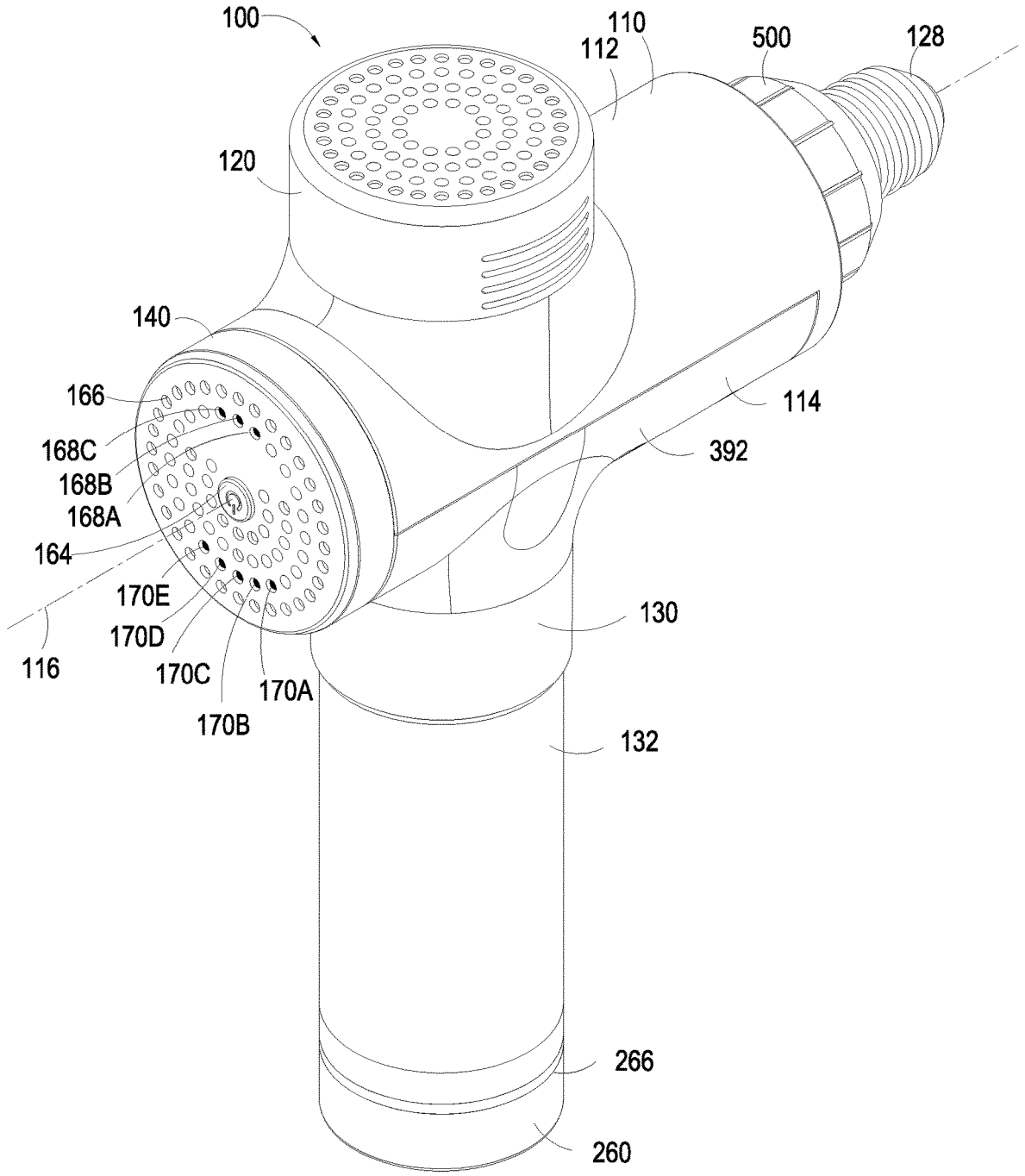
FIG. 2 illustrates a top perspective view of the percussive massage applicator of FIG. 1 showing the top, the right side and the proximal end of the applicator, the proximal end having indicator displays and a pushbutton to turn the applicator on and off and to control the operational speed (stroke frequency) of the applicator.
Figure 8:
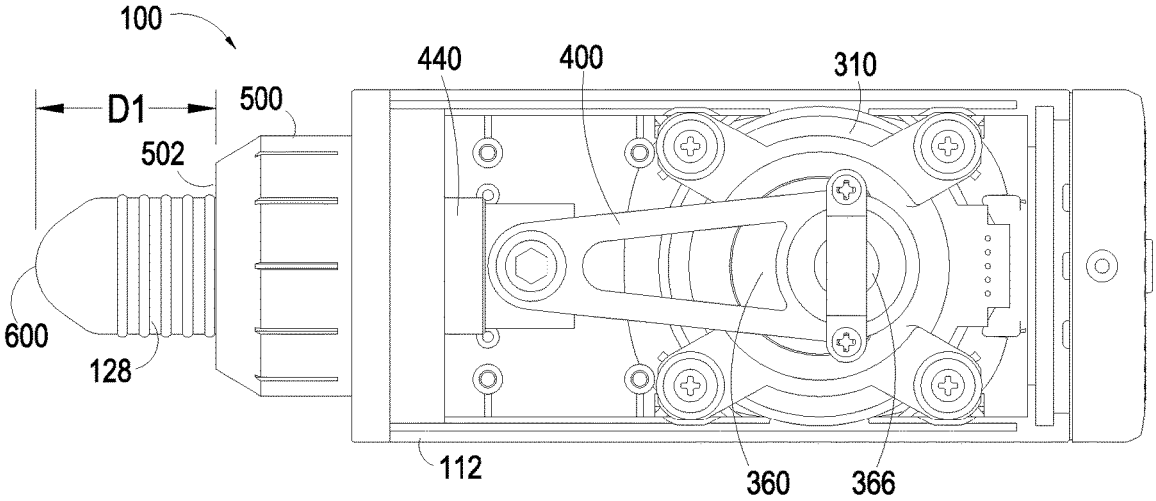
Figure 9:
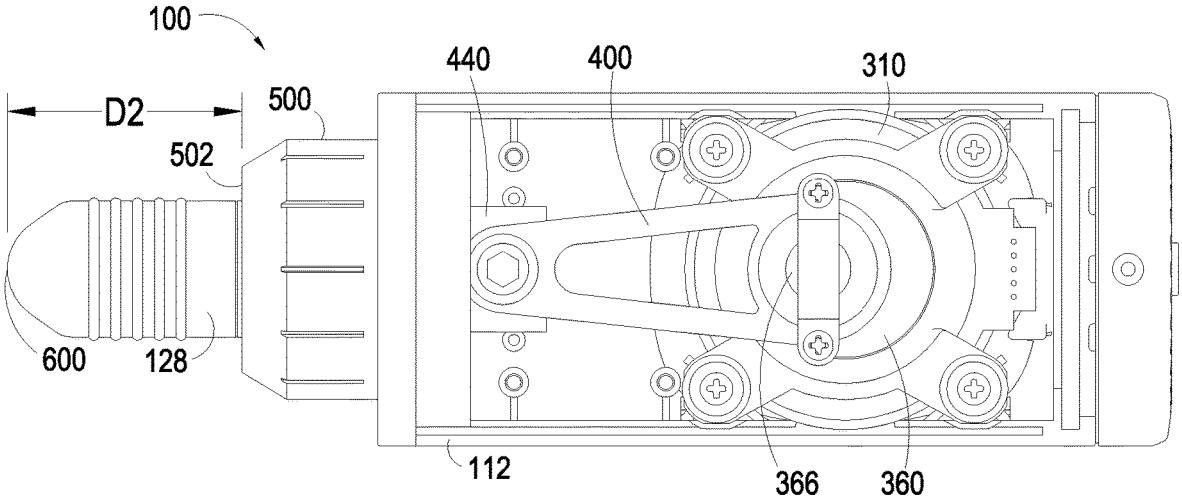

FIG. 8 illustrates a bottom plan view of the upper enclosure of FIGS. 1 and 2, the view in FIG. 8 having the lower housing removed to show the reciprocation assembly, the view in FIG. 8 showing the motor shaft at a rotational position wherein the applicator head is extended by a shortest distance from the cylinder housing; and FIG. 9 illustrates the bottom plan view of FIG. 8 with the motor shaft at a rotational position wherein the applicator head is extended by a longest distance from the cylinder housing.

DESCRIPTION OF ILLUSTRATED EMBODIMENTS

As used throughout this specification, the words "upper," "lower," "longitudinal," "upward," "downward," "proximal," "distal," and other similar directional words are used with respect to the views being described. It should be understood that the percussive massage applicator described herein can be used in various orientations and is not limited to use in the orientations illustrated in the drawing figures.

Figure 3:
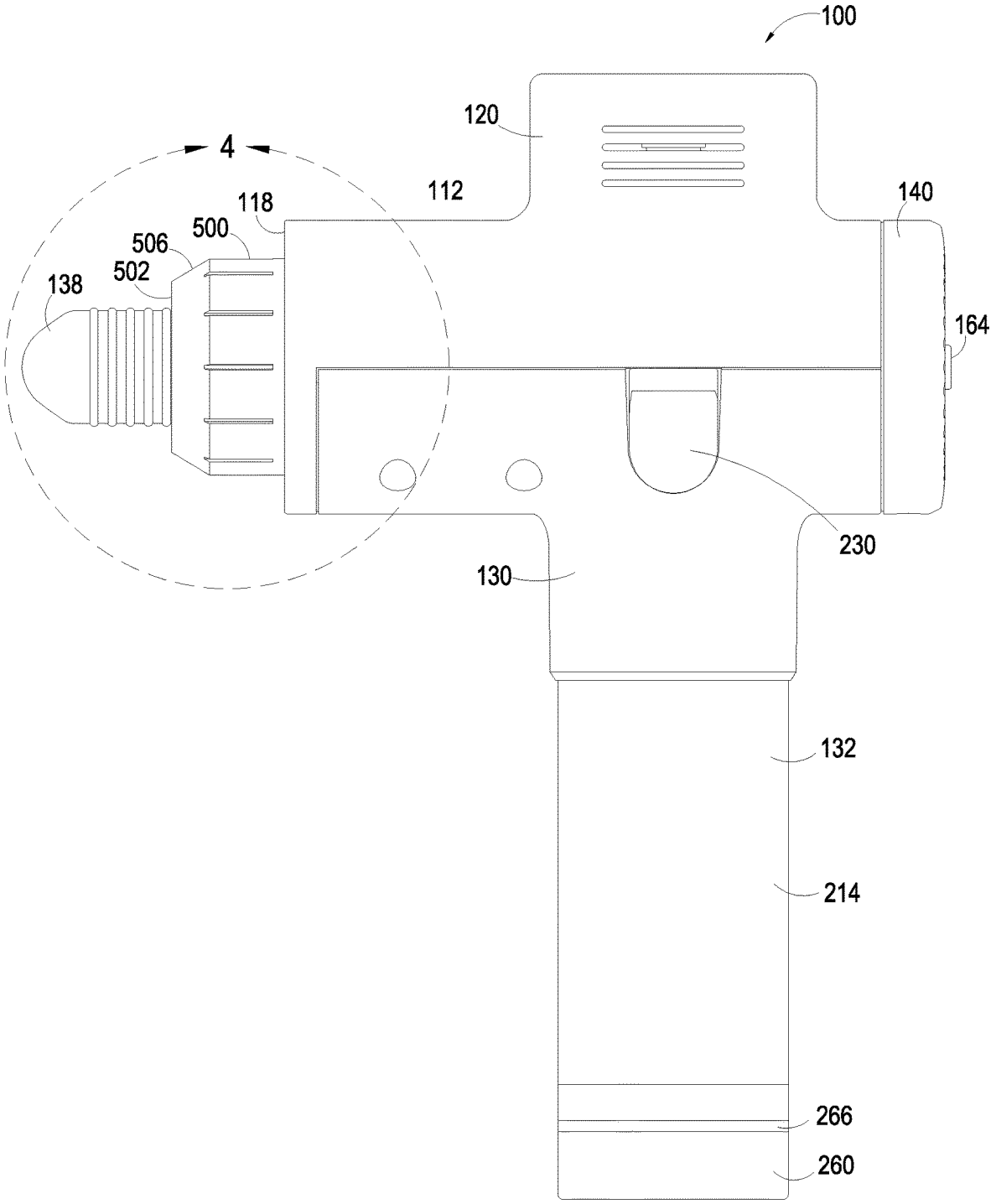
FIG. 3 illustrates a left elevational view of the percussive massage applicator of FIGS. 1 and 2.

A portable electromechanical percussive massage applicator ("percussive massage applicator") 100 is illustrated in FIGS. 1-3. The percussive massage applicator can be applied to different locations of body to apply percussion to the body to effect percussive treatment. The percussive massage applicator is operable with removably attachable applicator heads to vary the effect of the percussive strokes. The percussive massage applicator operates at a plurality of speeds (e.g., three speeds). The percussive massage applicator can be used by a massage therapist or other person to apply percussive massage to another person. The percussive massage applicator can also be used by the recipient of the massage therapy. The size and weight of the percussive massage applicator along with the cylindrical handle/battery assembly allow the percussive massage applicator to be self-applied to most muscles of a person's body.

Figure 5:
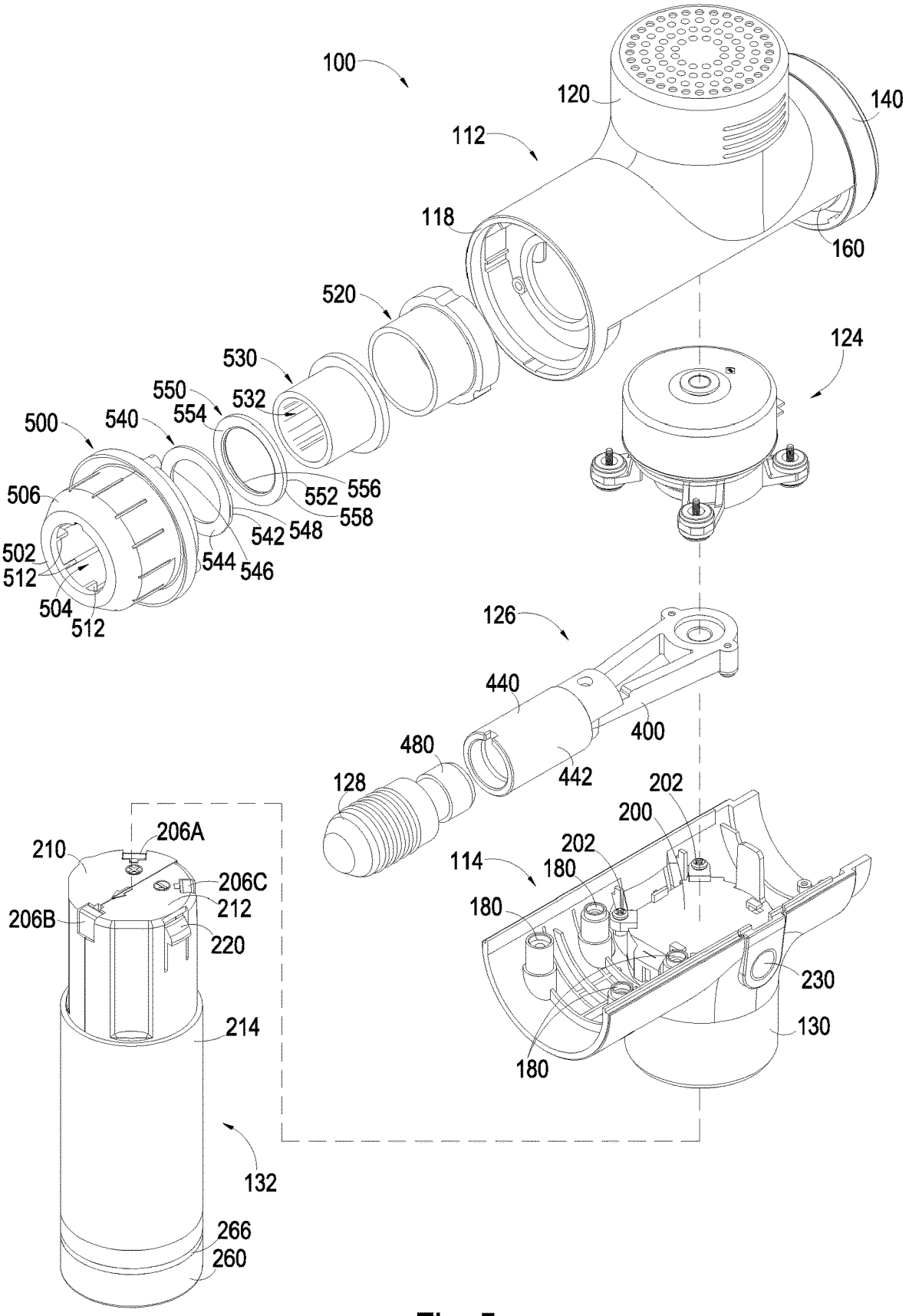
FIG. 5 illustrates a proximal perspective view of the outer sleeve of FIG. 4 showing the pedestals extending from a first inner surface of the outer sleeve to form a segmented second inner surface of the outer sleeve.

The portable electromechanical percussive massage applicator 100 includes a main body 110. The main body includes an upper body portion 112 and a lower body portion 114. The two body portions engage to form a generally cylindrical enclosure about a longitudinal axis 116 (FIG. 2). The upper body portion includes a distal end 118 (FIG. 5).

Figure 7:
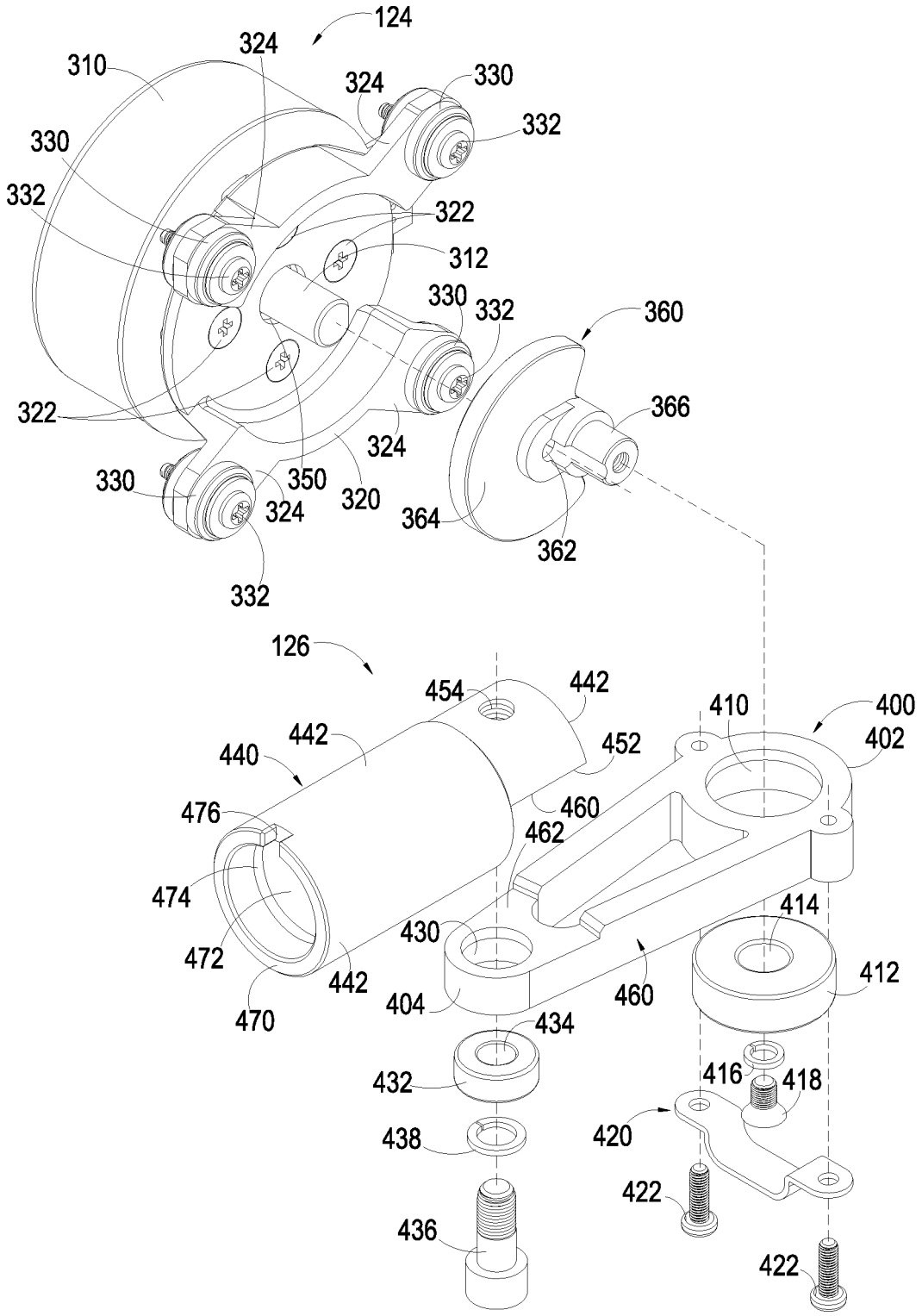
FIG. 7 illustrates a lower perspective view of the motor assembly rotated with respect to the reciprocation assembly with broken lines indicating the interrelationship of the motor assembly and the reciprocation assembly.

A generally cylindrical motor enclosure 120 extends upward from the upper body portion 112. The motor enclosure is substantially perpendicular to the upper body portion. The motor enclosure and the upper body portion house a motor assembly 124 (FIGS. 5 and 7). The upper body portion also supports a reciprocation assembly 126 (FIG. 7), which is coupled to the motor assembly as described below. The reciprocation assembly drives a removably attachable applicator head 128. The illustrated applicator head is bullet shaped. The applicator head is replaceable with applicator heads having different shapes adaptable to massaging different areas of a body with differing effects.

A generally cylindrical battery assembly receiving enclosure 130 extends downward from the lower body portion 114 and is substantially perpendicular to the lower body portion. A battery assembly 132 extends from the battery assembly receiving enclosure.

A main body endcap 140 is positioned on a proximal end of the main body 110. In addition to other functions described below, the main body endcap also serves as a clamping mechanism to hold the respective proximal ends of the upper body portion 112 and the lower body portion 114 together.

The main body endcap 140 houses a motor controller (main) printed circuit board (PCB) 160. A portion of the motor controller PCB is shown in FIG. 5. The proximal side of the main PCB supports a central pushbutton switch (not shown) which is actuated by a pushbutton actuator 164. The pushbutton actuator extends through the main body endcap as shown in FIG. 2. The pushbutton switch is responsive to manual actuation to turn the motor (described below) on and off and to select one of a plurality of operational speeds for the motor. As shown in FIG. 2, the pushbutton actuator is surrounded on the endcap by a plurality of bores 166, which extend perpendicularly from the outer (proximal) surface of the endcap to form a plurality of concentric rows of bores. Selected ones of the bores are through bores, which allow airflow through the endcap. Three of the bores above the switch have respective speed indication light-emitting diodes (LEDs) 168A, 168B, 168C positioned therein. The three LEDs provide an indication of the operational state of the percussive massage applicator 100 as described in more detail below. Five of the bores located below the pushbutton actuator have respective battery charge state LEDs 170A, 107B, 170C, 170D, 170E positioned therein. The five LEDs provide an indication of the charge state of the battery when the battery assembly 132 is attached and is providing power to the percussive massage applicator.

The upper enclosure 112 and the lower enclosure 114 are interconnected by a plurality of screws (not shown) which pass through a plurality of bores 180 (FIG. 4) in the lower enclosure and engage corresponding bores (not shown) in the upper enclosure.

As shown in FIG. 5, the lower body portion 114 includes a battery assembly receiving tray 200, which is secured to the inside of the lower body portion in alignment with the battery assembly receiving enclosure 130. The receiving tray is secured to the lower body portion with a plurality of screws 202 (e.g., four screws with only two shown in FIG. 5). The receiving tray includes a plurality of leaf spring contacts (e.g., three contacts not shown), which are positioned in a triangular pattern. The three contacts are positioned to engage a corresponding plurality of contacts 206A, 206B, 206C on the battery assembly 132 when the battery assembly is positioned in the battery assembly receiving enclosure.

The battery assembly 132 comprises six 4.2-volt lithium-ion battery cells connected in series to produce an overall battery voltage of approximately 25.2 volts when fully charged. The battery cells are commercially available from many suppliers, such as, for example, Samsung SDI Co., Ltd., of South Korea. Fewer or more battery cells with different voltages may also be used. The battery assembly comprises a first battery cover half 210 and a second battery half 212, which snap together. The two halves are further held together by an outer cylindrical cover 214, which also serves as a gripping surface when the percussive massage applicator 100 is being used. In the illustrated embodiment, the outer cover extends only over the portion of the battery assembly that does not enter the battery receiving enclosure 132. In the illustrated embodiment, the outer cover comprises neoprene or another suitable material that combines a cushioning layer with an effective gripping surface.

The upper end of the battery assembly 132 includes at least one mechanical engagement tab 220. When the battery assembly is fully inserted into the battery assembly receiving enclosure 130, the engagement tab engages a portion of the battery assembly receiving enclosure to secure the battery assembly within the battery assembly receiving enclosure.

The lower body portion 114 includes a mechanical button 230 in alignment with the engagement tab 220. When sufficient pressure is applied to the button, the first engagement tab is disengaged from the battery receiving enclosure. Once disengaged, the battery assembly is easily removed from the battery assembly receiving enclosure 130.

The battery assembly 132 includes a printed circuit board (not shown), which supports a battery controller (not shown). An example of a battery controller is illustrated in FIG. 23 of U.S. Pat. No. 10,314,762, which is incorporated by reference herein. The battery controller is housed within an endcap 260. A charging power adapter input jack 262 (FIG. 1) extends through the endcap to provide power to the battery controller. The battery controller further includes an on/off switch (not shown). In the illustrated embodiment, the on/off switch is a slide switch. A switch actuator extender 264 (FIG. 1) is positioned on the actuator of the slide switch and extends through the endcap to enable the slide switch to be manipulated from the outside of the endcap. The battery controller selectively illuminates a plurality of light-emitting diodes (LEDs) (e.g., six LEDs, not shown). The LEDs are mounted around the periphery of the battery controller PCB. In the illustrated embodiment, each LED is a dual-color LED (e.g., red and green), which may be illuminated to display either color. A translucent plastic ring 266 is secured to the battery assembly endcap such that the ring is generally aligned with the LEDs. Accordingly, light emitted by the LEDs is emitted through the ring. The color of the LEDs can be used to indicate the charged state of battery cells within the battery assembly 132. Additional information about the battery controller is provided in the above-identified patent.

As illustrated in FIG. 5, the motor enclosure 120 houses the electric motor assembly 124, which is also shown in FIG. 7. The electric motor assembly includes a brushless DC electric motor 310 having a central shaft 312 that rotates in response to applied electrical energy. In the illustrated embodiment, the electric motor is a 24-volt brushless DC motor. The electric motor may be a commercially available motor. The diameter and height of the motor enclosure and the mounting structures (described below) are adaptable to receive and secure the electric motor within the motor enclosure.

The electric motor 310 is secured to a motor mounting bracket 320 via a plurality of motor mounting screws 322. The motor mounting bracket includes a plurality of mounting tabs 324 (e.g., four tabs). Each mounting tab includes a central bore, which receives a respective rubber grommet 330, wherein first and second enlarged portions of the grommet are positioned on opposite surfaces of the tab. A respective bracket mounting screw 332 having an integral washer is passed through a respective central hole in each grommet to engage a respective mounting bore (not shown) in the upper body portion 112. The grommets serve as vibration dampers between the motor mounting bracket and the upper body portion.

The central shaft 312 of the electric motor 310 extends through a central opening 350 in the motor mounting bracket 320. The central shaft engages a central bore 362 of an eccentric crank 360 (only an outer, smaller diameter portion of the central bore is shown in FIG. 7). The central bore is press-fit onto the central shaft of the electric motor or is secured to the shaft by another suitable technique (e.g., using a setscrew (not shown)). The eccentric crank includes a counterweight portion 364 and a pivot 366. The counterweight and the pivot are positioned 180 degrees apart from each other with respect to the central bore. The pivot is centered at a selected distance (e.g., 10 millimeters in the illustrated embodiment) from the central shaft of the eccentric crank.

As further illustrated in FIG. 5, the reciprocation assembly 126 includes a reciprocation link rod 400 having a first (driven) end 402 and a second (driving) end 404. The driven end includes a first cylindrical bearing housing 410 that retains a first bearing 412. The first bearing has a central bore 414 sized to fit around the pivot 366 of the eccentric crank 360. The central bearing is secured to the pivot via a lock washer 416 and a bearing screw 418. The bearing screw engages a central bore 368 of the pivot. In the illustrated embodiment, a metal shield 420 is positioned over the head of the screw and secured to the bearing housing by a plurality (e.g., two) of shield screws 422. The metal shield prevents the bearing screw from disengaging from the central bore of the pivot if vibration or other forces cause the bearing screw to rotate with respect to the central bore.

The reciprocation link rod 400 further includes a second cylindrical bearing housing 430 at the driving end. The second bearing housing retains a second bearing 432 having central bore 434. The central bore of the second bearing receives a screw 436 that passes through a lock washer 438.

The reciprocation assembly further includes a cylindrical piston 440 having a cylindrical distal portion 442 having an outer surface 444. A proximal end of the piston comprises an extended platform 450. As viewed in FIG. 7, the extended platform has a flattened lower portion 452. A threaded bore 454 passes through the extended platform. The second bearing 432 is secured to the threaded bore of the piston using the screw 436 such that the flattened lower portion of the extended platform is parallel to and spaced apart from a flattened portion 460 of the driven end 404 of the reciprocation rod 400 when the screw is tightened to rotatably engage the piston and the reciprocation rod.

Figure 6:
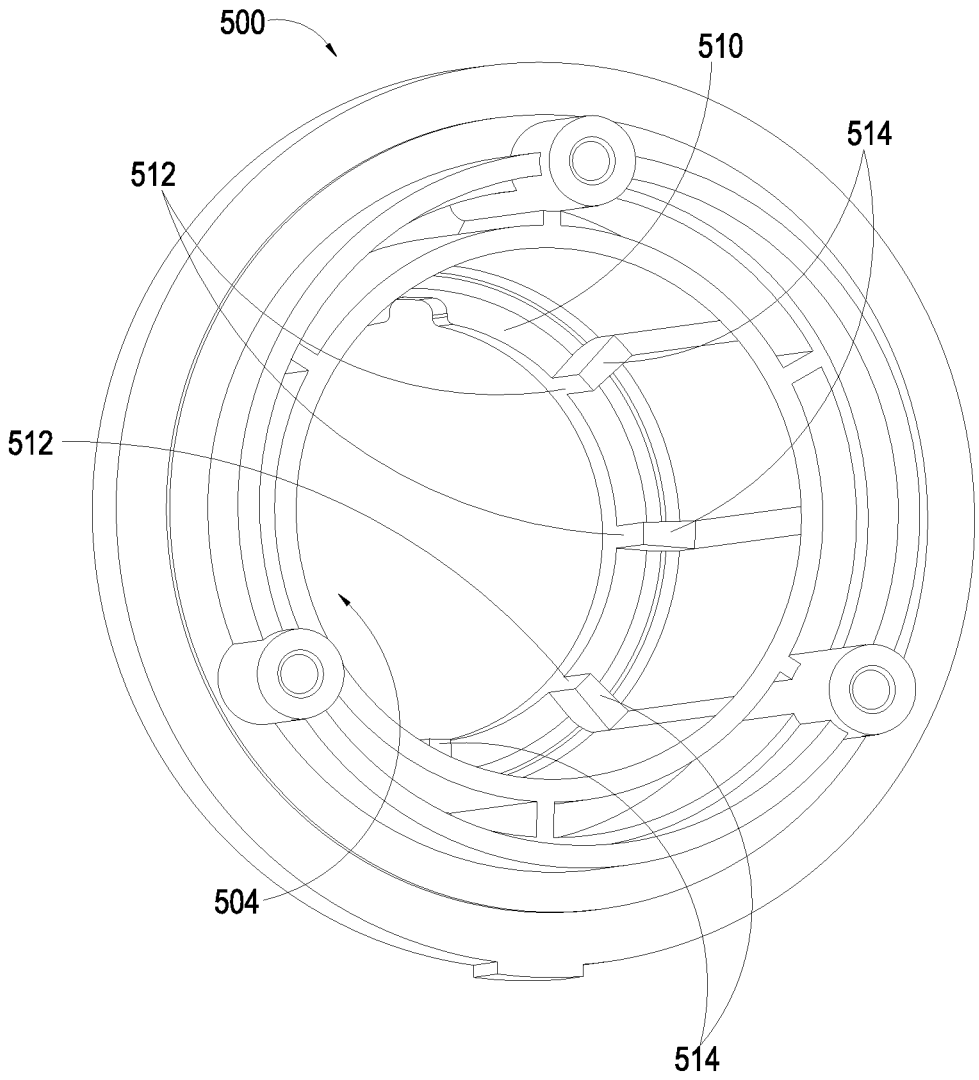
FIG. 6 illustrates an exploded perspective view of the percussive massage applicator of FIGS. 1-5, the view showing the upper housing, a motor assembly, a reciprocation assembly, a cylinder housing, a lower housing, a removable battery assembly, and the components within the outer sleeve of the distal end of the percussive massage applicator.

The cylindrical distal portion 442 of the piston 440 has an outer diameter of approximately 25.14 millimeters. A second end 470 of the piston has a cylindrical bore 472 formed therein. The central bore has a diameter of approximately 19 millimeters. A circumferential recessed groove 474 is formed in the central bore approximately 7 millimeters inward from the second end. A notch 476 is formed at a location around the perimeter of the second end of the piston. The central bore sized to receive an engagement portion 480 (FIG. 5) of the applicator head 128. The illustrated applicator head is rotationally symmetrical about the longitudinal axis 116 of the enclosure; and the notch is not needed to position the applicator head. For non-rotationally symmetrical applicator heads (not shown), the notch may be engaged by an alignment protrusion to maintain the applicator head in a fixed rotational orientation with respect to the enclosure 110. The groove is not used in the illustrated embodiment. The groove may be used to engage a circumferential protrusion on the engagement portion of other applicator heads The distal end of the upper body portion 112 supports a generally cylindrical outer sleeve 500 having a central bore 502. In the illustrated embodiment, a distal portion 506 proximate to a distal end 504 of the outer sleeve is tapered inward toward the central bore. The outer sleeve has an annular base that is secured to the distal end of the upper body portion by a plurality of screws (e.g., three screws, not shown). The outer sleeve has a first inner surface 510 shown in FIG. 6. As further shown in FIG. 6, a plurality of pedestals 512 extend longitudinally inward (e.g., proximally) from the first inner surface. Each pedestal has a respective end surface that is parallel to the first inner surface of the outer sleeve. Together, the end surfaces of the pedestals form a segmented second inner surface 514 of the outer sleeve. In the illustrated embodiment, the segmented inner surface comprises seven segments (three segments and a partial fourth segment shown in FIG. 6).

The outer sleeve 500 surrounds a generally cylindrical mounting sleeve 520 that is secured within the outer sleeve when the outer sleeve is secured to the upper body portion 112. In the illustrated embodiment, the mounting sleeve comprises silicone rubber or another suitable flexible material. The mounting sleeve surrounds a cylinder body 530 having a central bore 532. The cylinder body is described in more detail below. The mounting sleeve secures the cylinder body in a concentric position with respect to the longitudinal axis 116 (FIG. 2) of the percussive massage applicator 100. In addition to securing the cylinder body, the mounting sleeve serves as a vibration damper to reduce vibrations propagating from the cylinder body to the main body 110 of the percussive massage applicator. The cylinder body has a distal end 532.

The outer sleeve 500 further surrounds an annular gasket 540 having a proximal surface 542, a distal surface 544, an outer peripheral surface 546 and an inner peripheral surface 548. The outer sleeve further surrounds a pressure ring 550 having a proximal surface 552, a distal surface 554, an outer peripheral surface 556 and an inner peripheral surface 558. The annular gasket and the pressure ring are centered about the longitudinal axis 116 (FIG. 2). The proximal surface of the pressure ring is positioned against the distal end 532 of the cylinder body. The proximal surface of the annular gasket is positioned against the distal surface of the pressure ring. The distal surface of the annular gasket is positioned against the segmented second inner surface 514 of the outer sleeve as shown in the cross-sectional view of FIG. 4.

Figure 4:
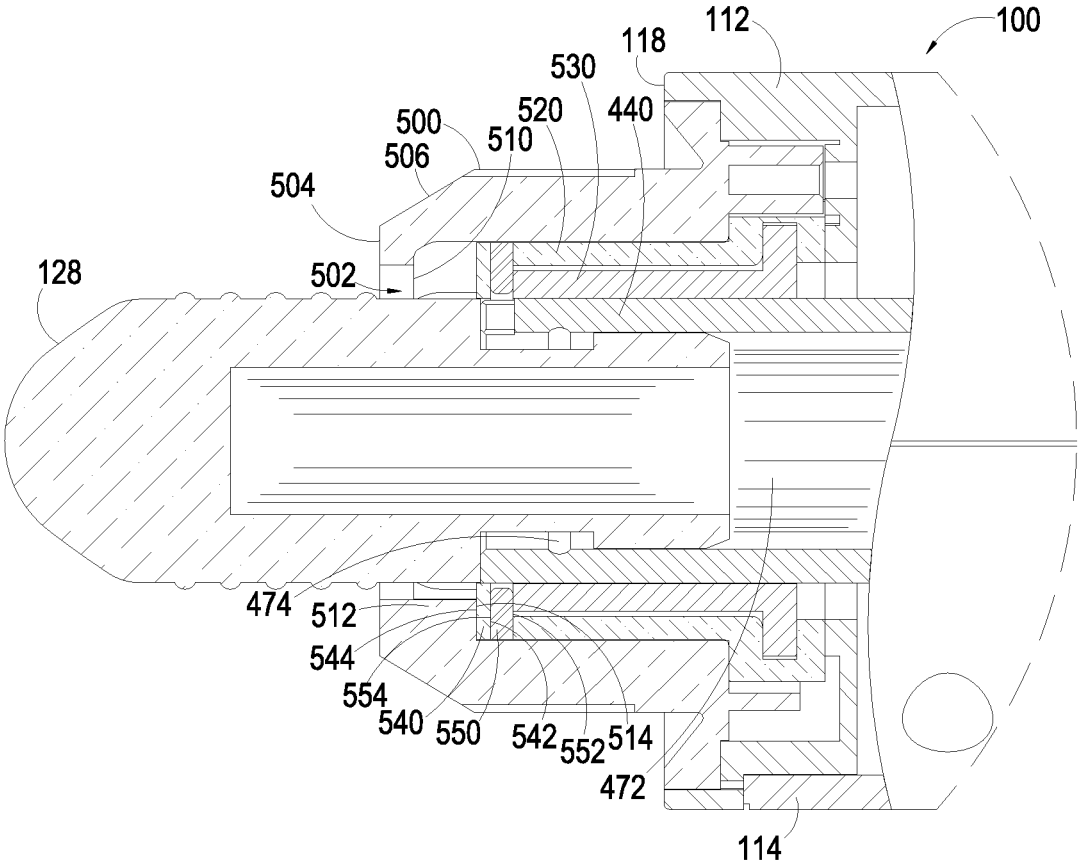
FIG. 4 illustrates a partially cross-sectioned left elevational view of the percussive massage applicator of FIGS. 1-3 taken within the area—4—of FIG. 3, the view in FIG. 4 showing a piston, a cylinder, a felt bushing and a pressure ring within an outer sleeve.

As shown in the cross-sectional view of FIG. 4, the mounting sleeve 520, the cylinder body 530, the pressure disk 550, and the annular gasket 550 are positioned within the outer sleeve 500 in the relative positions described above. The outer sleeve is secured to the distal end 118 of the upper body 112 of the percussive massage device 100. The piston 440 fits within the central bore 532 of the cylinder body.

In the illustrated embodiment, the cylinder body 530 comprises an oil-impregnated copper or bronze bearing, which is commercially available from National Bronze Manufacturing, Inc., of Roseville, Mich., or another suitable self-lubricating bearing. For example, in one embodiment, the cylinder body comprises a sintered alloy of approximately 90-95 percent copper and approximately 5-10 percent tin. The lubricant is impregnated into the cylinder body during the manufacturing process. In one embodiment, the sintered alloy comprises approximately 87 percent by volume of the cylinder body, and the lubricant comprises approximately 13 percent by volume of the cylinder body. In the illustrated embodiment, the central bore 532 of the cylinder body has an inner diameter of approximately 26.18 millimeters, which is only slightly larger than the 26.14-millimeter outer diameter of the piston 440. Thus, the cylinder body and the piston have a very close tolerance to reduce relative radial movement of the piston within the cylinder body, which has the effect of reducing operating noise of the system.

When the percussive massage device 100 is operating, only a small amount of lubricant is released from the cylinder body 530 to form a uniform protective film over the inner surface of the cylinder body in contact with the outer surface of the piston 440 to allow the piston to reciprocate smoothly and quietly within the cylinder body. Although the film forms a thin layer, a small amount of the lubricant may migrate to the distal end of the piston and onto the applicator head 128. Even a small amount reaching the applicator head may be noticeable by a user. If the applicator head is applied to a subject through clothing, the lubricant may stain the clothing. The annular gasket 530 substantially reduces or eliminates the migration of lubricant to the applicator head.

In the illustrated embodiment, the annular gasket 530 comprises a commercially available wool felt material. The material has an uncompressed thickness in a range of approximately 1.2 millimeters to approximately 2 millimeters. The gasket has an outer diameter of approximately 35 millimeters and has an inner diameter of approximately 25.14 millimeters, which corresponds to the outer diameter of the piston 440. The density of the material is approximately 3-3.5 grams per cubic centimeter. The gasket material has an ability to absorb liquified lubricant having a weight of approximately 300 percent of the weight of the gasket. Because the distal surface 544 of the annular gasket is positioned against the segmented second inner surface 514 of the outer sleeve 500, the annular gasket is able to expand in the spaces formed between the pedestals 512 to absorb the lubricant.

In the illustrated embodiment, the annular retention disk 532 comprises polypropylene or another suitable plastic material. The retention disk has a thickness of approximately 2 millimeters. The retention disk has an outer diameter of approximately 35 millimeters, which corresponds to the outer diameter of the annular gasket 530 and to the inner diameter of the outer sleeve 500 where the retention disk and the annular gasket are positioned. The retention disk has an inner diameter of approximately 25.95 millimeters, which is slightly larger than the outer diameter of the piston 440 so that the inner circumference of the retention disk does not contact the outer surface of the piston.

After installing the reciprocation assembly 126, as described above, the lower body portion 114 is installed by aligning the lower body portion with the upper body portion 112 and securing the two body portions together. The main body endcap 140 is then placed over the proximal ends of the two body portions to further secure the two body portions together.

The battery assembly 132 is installed in the battery assembly receiving enclosure 130 of the lower body portion 114 of the percussive massage applicator 100 and electrically and mechanically engaged as described above. The battery assembly may be charged while installed; or the battery assembly may be charged while removed from the percussive massage applicator.

The operation of the percussive massage applicator 100 is illustrated in FIGS. 8 and 9, which are views looking up at the motor assembly in the upper body portion 112 with the lower cover 114 and the battery assembly 132 removed.

In FIG. 8, the shaft 312 (FIG. 7) of the motor 310 is rotated to a first rotational position, which is referred to herein as the 0-degree position. In this position, the pivot 366 of the eccentric crank 360 is located at the farthest distance from the distal end 504 of the outer sleeve 500 of the percussive massage applicator 100. Accordingly, the piston 440 is retracted inwardly from the distal end of the outer sleeve such that a distal end 600 of the applicator head 128 is located a shortest distance (D1) from the distal end of the outer sleeve.

In FIG. 9, the shaft 312 (FIG. 7) of the motor 310 is rotated to a second rotational position, which is referred to herein as the 180-degree position. In this position, the pivot 366 of the eccentric crank 360 is located at the closest distance to the distal end 504 of the outer sleeve 500 of the percussive massage applicator 100. Accordingly, the piston 440 is extended toward the distal end of the outer sleeve such that the distal end 600 of the applicator head 128 is located a farthest distance (D2) from the distal end 504 of the outer sleeve 500 reciprocation assembly.

The reciprocation of the distal end 550 of the applicator head 128 occurs at the rotation rate of the motor 310. In the illustrated embodiment, the rotation rate can be selected from 2,000 revolutions per minute (RPM), 2,600 RPM or 3,000 RPM corresponding to 2,000 strokes per minute, 2,600 strokes per minute and 3,000 strokes per minute, respectively.

When the percussive massage device 100 is operating, the piston 440 passes through the retention disk 532 and through the annular gasket 530. Because the inner circumference of the annular gasket contacts the outer surface of the piston, any lubricant accumulating on the outer surface of the piston is wiped from the piston and is absorbed by the wool felt material of the gasket. Because of the high absorbency of the wool felt material, very little, if any, of the lubricant on the outer surface of the piston reaches the distal end 470 of the piston. Thus, the lubricant is not transferred to the applicator head 128.

As discussed above, the bullet-shaped applicator head 128 is removably attached to the piston 440. The bullet-shaped applicator head may be disengaged from the piston and replaced with other applicators, which are shown, for example, in U.S. Pat. No. 10,314,762, which is incorporated by reference herein.

The portable electromechanical percussive massage applicator 100 may be provided with power and controlled in a variety of manners. An exemplary battery control circuit is described, for example, with respect to FIG. 23 of the above-identified U.S. Pat. No. 10,314,762. Exemplary motor control circuits are described, for example, with respect to FIG. 24 and FIG. 27 of the same patent.

As various changes could be made in the above constructions without departing from the scope of the invention, it is intended that all the matter contained in the above description or shown in the accompanying drawings shall be interpreted as illustrative and not in a limiting sense.

What is claimed is:

1. A percussive massage device comprising:

an enclosure having a proximal end and a distal end;

a motor positioned within the enclosure, the motor operable to rotate a crank having an offset pivot;

a reciprocation linkage having a proximal end and a distal end, the proximal end coupled to the offset pivot of the crank;

an outer sleeve mounted to the distal end of the enclosure, the outer sleeve having a proximal end and a distal end, the proximal end of the outer sleeve attached to the distal end of the enclosure, the outer sleeve having an inner surface;

a self-lubricating cylinder positioned within the outer sleeve, the cylinder having a proximal end and a distal end;

a piston positioned through the cylinder, the piston having a proximal end and a distal end, the proximal end of the piston coupled to the distal end of the reciprocation linkage, the distal end of the piston extending from the distal end of the cylinder;

an annular gasket having a distal surface positioned against the inner surface of the outer sleeve and having a proximal surface;

a pressure ring having a distal surface positioned against the proximal surface of the annular gasket and having a proximal surface positioned against the distal end of the cylinder; and an applicator head having a distal end and a proximal end, the proximal end of the applicator head removably couplable to the distal end of the piston, the proximal end of the applicator head exposed outside the distal end of the outer sleeve.

2. The device as defined in claim 1, wherein the annular gasket comprises a wool felt material.

3. The device as defined in claim 2, wherein the wool felt material of the annular gasket has a density in a range of 3 grams to 3.5 grams per cubic centimeter.

4. He device as defined in claim 3, wherein the wool felt material has an uncompressed thickness in a range of 1.2 millimeters to 2 millimeters.

5. The device as defined in claim 1, wherein:

the annular gasket has an inner peripheral surface, the inner peripheral surface having an inner diameter;

the piston has a cylindrical outer surface, the outer surface having an outer diameter; and the inner diameter of the peripheral surface of the annular gasket is substantially equal to the outer diameter of the outer surface of the piston.

6. The device as defined in claim 1, wherein the pressure ring comprises polyethylene.

7. The device as defined in claim 6, wherein:

the piston has a cylindrical outer surface, the outer surface having an outer diameter; and the pressure ring has an inner peripheral surface having an inner diameter, the inner diameter of the inner peripheral surface of the pressure ring greater than the outer diameter of the outer surface of the piston.

8. The device as defined in claim 1, wherein:

the inner surface of the outer sleeve comprises a plurality of inner surface segments, each inner surface segment spaced part from adjacent inner surface segments; and the annular gasket is compressed between the pressure ring and each of the inner surface segments.

9. A method of operating a percussive massage device comprising:

rotating a shaft of an electric motor to rotate a pivot of a crank about a centerline of the shaft;

coupling the pivot of the crank to a proximal end of an interconnection linkage;

coupling a distal end of the interconnection linkage to a proximal end of a piston;

constraining the piston to reciprocate within a central bore of a self-lubricating cylinder body, an outer surface of the piston receiving lubricant from the cylinder body;

passing the piston through an annular gasket, the annular gasket having an inner perimeter positioned in contact with the outer surface of the piston, the annular gasket absorbing lubricant from the outer surface of the piston; and coupling a second end of the piston to an applicator head, wherein rotational movement of the pivot of the crank causes reciprocating longitudinal movement of the piston and the applicator head, and wherein the annular gasket inhibits the lubricant on the outer surface of the piston from reaching the applicator head.

10. The method as defined in claim 9, further comprising:

positioning the cylinder body within an outer sleeve, the outer sleeve having an inner segmented surface having a plurality of surface segments; and positioning the annular gasket between a pressure ring and the plurality of surface segments of the inner segmented surface to enable the annular gasket to expand between the surface segments.

* * * * *